United States Patent [19]

Robillard

[11] 4,192,048

[45] Mar. 11, 1980

[54] TEXTURIZING A TEXTILE PRODUCT

[75] Inventor: Jean J. Robillard, Voltaire, France

[73] Assignee: Pierre Wahl, Geneva, Switzerland

[21] Appl. No.: 857,179

[22] Filed: Dec. 2, 1977

[30] Foreign Application Priority Data

Dec. 2, 1976 [FR] France ..... 76 36320

[51] Int. Cl.[2] ..... D02G 1/00; D02J 1/22

[52] U.S. Cl. ..... 28/246; 28/247; 28/259; 264/27; 264/69; 264/288.8; 264/289.3; 264/290.7

[58] Field of Search ..... 28/240, 245, 246, 247, 28/259, 260, 261, 219, 220; 264/22, 27, 69, 70, 288, 290 R, 290 N, 290

[56] References Cited

U.S. PATENT DOCUMENTS

| | | | |
|---|---|---|---|
| 2,402,609 | 6/1946 | Brabander | 28/246 X |
| 3,108,323 | 10/1963 | Sikorski | 28/246 X |
| 3,154,835 | 11/1964 | Palma et al. | 28/260 |
| 3,791,120 | 2/1974 | Hess | 28/240 X |

FOREIGN PATENT DOCUMENTS

| | | | |
|---|---|---|---|
| 2044524 | 2/1971 | France | 28/246 |

*Primary Examiner*—Louis Rimrodt

*Attorney, Agent, or Firm*—Robert E. Burns; Emmanuel J. Lobato; Bruce L. Adams

[57] ABSTRACT

A textile product formed of at least one thermoplastic yarn is texturized by subjecting the yarn simultaneously to a mechanical traction force and a high frequency electrical field applied at local points on the yarn. In order to increase the efficiency of texturizing, the yarn is moistened before it is subjected to the electrical field.

11 Claims, 2 Drawing Figures

TEXTURIZING A TEXTILE PRODUCT

BACKGROUND OF THE INVENTION

This invention relates to a method of texturising, e.g. crimping, a textile product formed of at least one thermoplastic synthetic yarn, such as a nylon yarn, an installation for effecting the method, and the application of the method to various textile products.

According to a known texturising method, the yarn is subjected simultaneously to a mechanical traction force and a high frequency electrical field applied at local points on the yarn. Such a method is described in French Patent Application No. 69,16911, now French Patent No. 2,044,524. Its main drawback is that its efficiency is limited.

SUMMARY OF THE INVENTION

The texturising method according to the present invention enables this efficiency to be considerably increased. To this end, the method is characterised by moistening the yarn before subjecting it to the high frequency electrical field.

BRIEF DESCRIPTION OF THE DRAWINGS

The accompanying drawings show by way of example one embodiment of the installation for effecting a method according to the invention. In the drawings.

DESCRIPTION OF THE PREFERRED EMBODIMENT

Figure 1:
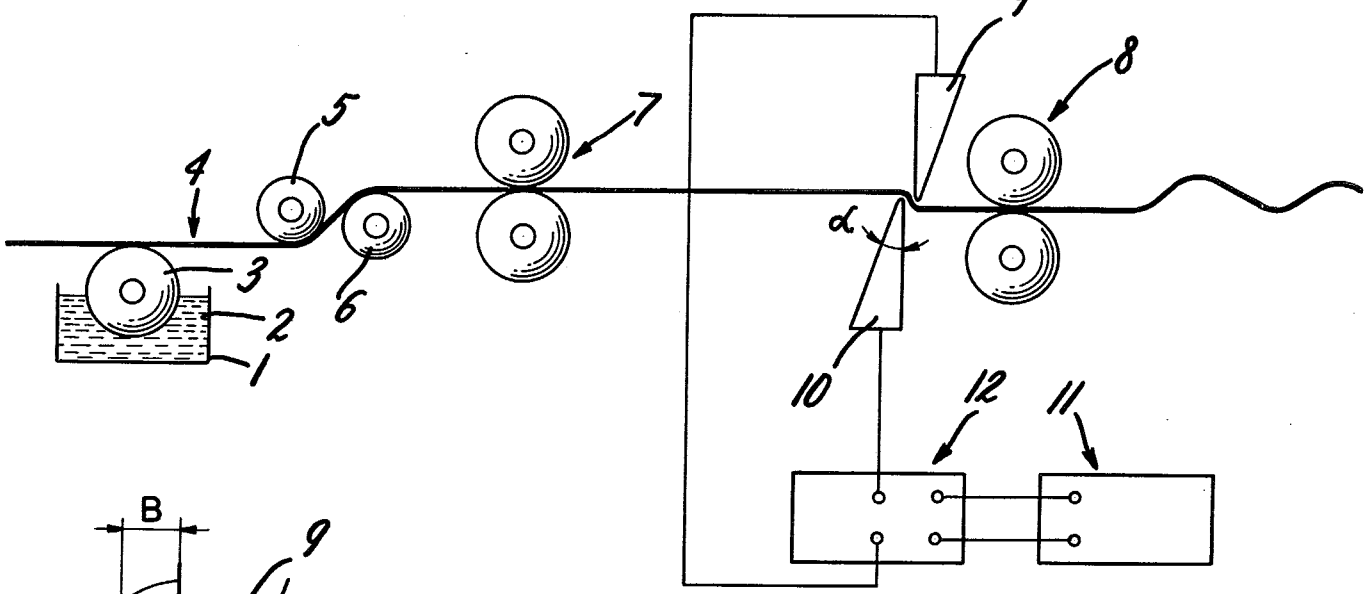
FIG. 1 is a diagrammatic side view of the installation.

The installation shown comprises a tank 1 containing water 2 to which a surface active agent, for example LISSAPOL or TX 209, has been added to a concentration of a few percent, and in which a moistening roller 3 is partly immersed. The thermoplastic synthetic yarn 4 to be treated, originating from a feed spindle (not shown), passes over the roller 3, so causing it to rotate.

The surface of the roller 3 becomes covered with a water film during its passage through the tank 1, and deposits the water on the yarn 4 during their mutual contact. On leaving the roller 3, the moist yarn passes over idle rollers 5 and 6, then between two parallel spaced-apart pairs of driven rollers 7 and 8. The rollers 8 rotate at a peripheral speed higher than the rollers 7, so that the yarn is stretched with a predetermined traction or tensile force (for example of the order of 10 grams).

Figure 2:
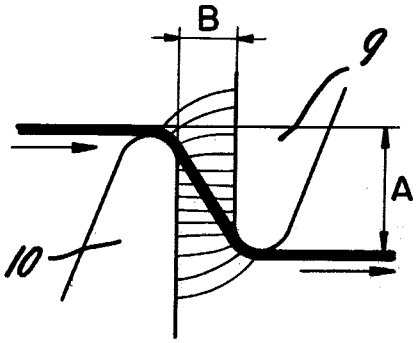
FIG. 2 is a view of a detail on a larger scale.

Between the pairs of rollers 7 and 8 there are disposed two identical electrodes 9 and 10 between which the yarn 4 passes. The electrodes 9 and 10 are prismatic in shape. In cross-section they are each in the form of a right-angled triangle whose apex angle $\alpha$ is of the order of 20°. They are disposed with their corresponding faces parallel and the dihedrals (FIG. 2) corresponding to the angle $\alpha$ overlapping for a distance A of the order of 2 mm, with the opposing faces being spaced apart by a distance B of about 1 mm.

The moistened yarn 4 moves generally perpendicular to the opposing faces of the electrodes 9 and 10. It slides on the slightly rounded edges of the electrodes, undergoing a downward displacement equal to the distance A after two changes of direction.

The electrodes 9 and 10 are connected respectively to the output of a high frequency generator 11 via means 12 (e.g. a timer or a modulator) which enable voltage to be applied across the electrodes at determined adjustable time intervals.

In traversing the variable high frequency electrical field present between the electrodes, the yarn locally undergoes structural modifications such that at the outlet of the pair of rollers 8 it assumes an undulated form as shown on the drawing.

With the installation described above it was possible to crimp a band of 600 thermoplastic synthetic yarns (70 denier nylon) at feed speeds varying from 50 to 600 meters/minute. Texturisation of this band at a speed of 600 meters/minute required at 22 kW high frequency voltage generator.

With the same installation it was possible to treat fabrics comprising thermoplastic synthetic fibres at a feed speed of 100 meters/minute.

The invention is obviously not limited to the means for effecting the method as described above with reference to the drawings. In particular, the yarn could be moistened by sprinkling, or by condensation by causing it to pass through a region filled with steam, for example.

The main advantage of the method according to the invention over known methods is better texturising at relatively high speeds. In other words, the method according to the invention enables the production speed to be considerably increased for equal quality, or quality to be considerably increased for the same production speed. Such improvements are attributable not only to the moistening of the yarn but also to the shape and arrangement of the electrodes.

I claim:

1. A method of texturizing thermoplastic yarn comprising, moistening with a liquid thermoplastic yarn to be texturized, applying a tensile force to the moistened yarn and while applying said force subjecting local lengths of said yarn to a high frequency electrical field to heat it and simultaneously crimping said local lengths of yarn the moistened yarn being advanced longitudinally while applying said tensile force and said crimping being accomplished by change of directions of longitudinal advancement of said yarn at successive lengths of the yarn longitudinally of the yarn, and simultaneously subjecting the yarn to said high frequency electrical field during said change of direction of longitudinal advancement.

2. A method of texturizing a thermoplastic yarn according to claim 1, in which said electrical field is developed periodically as said yarn is continuously advanced longitudinally thereby spacing the crimps longitudinally on said yarn.

3. A method of texturizing a thermoplastic yarn according to claim 1, in which said change of directions is accomplished by advancing said yarn over two electrically energized electrodes.

4. A method of texturizing a themoplastic yarn according to claim 3, in which said electrodes are provided with surfaces thereof over which said yarn is advanced longitudinally and spaced relative to each other to effect said change of directions of advancement.

5. A method of texturizing a thermoplastic yarn according to claim 4, in which said surfaces are disposed to effect said change of directions of advancement of the yarn longitudinally.

6. Apparatus for texturizing thermoplastic yarn comprising, a pair of electrodes electrically energized having surfaces over which a moistured thermoplastic yarn is advanced while the electrodes are energized, said electrodes having surfaces over which said yarn is advanced longitudinally and spaced relatively to effect a change of direction of travel of said yarn to thereby heat said yarn and crimp it, and means for advancing said yarn longitudinally subject to application of a tensile force thereto while advancing it.

7. Apparatus for texturizing thermoplastic yarn according to claim 6, including means to enertize said electrodes to develop an electrical field to heat the yarn advanced over the electrodes.

8. Apparatus for texturizing thermoplastic yarn according to claim 7, including means to electrically energize the electrodes.

9. Apparatus for texturizing thermoplastic yarn according to claim 6, including means for moistening the yarn prior to contacting said electrodes.

10. Apparatus for texturizing thermoplastic yarn according to claim 9, in which said means for moistening comprises means upstream of the electrodes for containing a moistening liquid for advancing said yarn longitudinally therethrough.

11. Apparatus for texturizing thermoplastic yarn according to claim 6, in which said surfaces are disposed to effect changes of direction of travel 90° to the initial direction of travel and then back to said initial direction.

* * * * *